US006155186A

United States Patent [19]

Schramayr et al.

[11] Patent Number: 6,155,186

[45] Date of Patent: Dec. 5, 2000

[54] APPARATUS AND METHOD FOR STITCHING A MATERIAL PORTION

[75] Inventors: Ernst Schramayr, Barneveld; Robert J. Beasock, Clark Mills, both of N.Y.

[73] Assignee: Jet Sew Technologies, Inc., Barneveld, N.Y.

[21] Appl. No.: 09/237,795

[22] Filed: Jan. 27, 1999

[51] Int. Cl.[7] ..... D05B 23/00

[52] U.S. Cl. ..... 112/9

[58] Field of Search ..... 112/303, 308, 112/306, 309, 311, 320, 9, 260, 475.04, 475.08

[56] References Cited

U.S. PATENT DOCUMENTS

| | | | |
|---|---|---|---|
| 2,879,875 | 3/1959 | Swackhamer | 112/9 X |
| 3,159,125 | 12/1964 | Vandewouwer | 112/260 |
| 3,221,685 | 12/1965 | Greenberg | 112/9 X |
| 4,374,501 | 2/1983 | Bell, Jr. et al. | 112/260 X |
| 4,441,444 | 4/1984 | Jung | 112/260 X |
| 4,498,404 | 2/1985 | Sadeh | 112/308 X |
| 5,560,308 | 10/1996 | Eto | 112/309 X |

*Primary Examiner*—Ismael Izaguirre

[57] ABSTRACT

An apparatus and method for automatically stitching a material portion by moving the material portion over a sewing table relative to a sewing head. In particular, the present invention includes a structure, device, or other mechanism for reducing friction between the material portion and the sewing table, whereby the material portion is more easily movable over the sewing table. The present invention especially relates to the manufacture of mats having a non-skid backing which would otherwise be very difficult to move relative to a sewing head for sewing the mats.

53 Claims, 8 Drawing Sheets

FIG. 8(a)
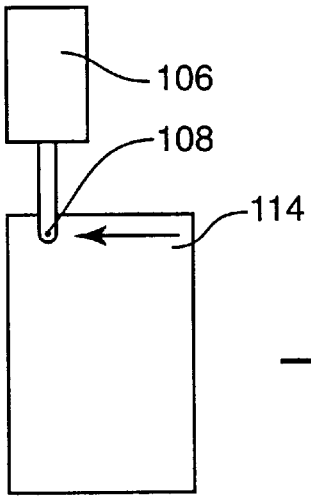
FIG. 8(b)
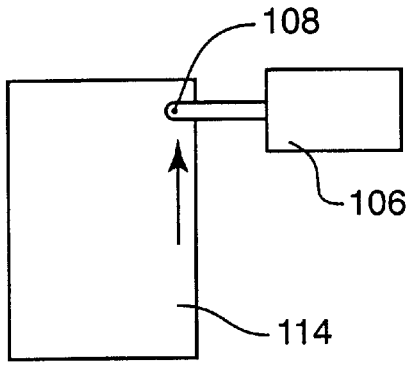
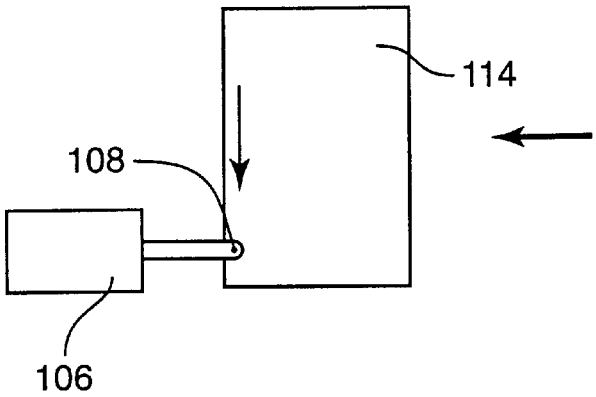
FIG. 8(d)
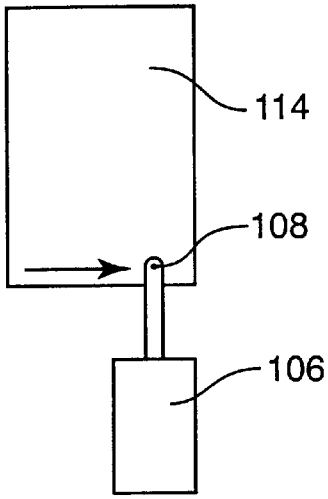
FIG. 8(c)

APPARATUS AND METHOD FOR STITCHING A MATERIAL PORTION

FIELD OF THE INVENTION

The present invention relates to an apparatus and method for stitching a material portion, especially for binding an edge of the material portion. More particularly, the present invention relates to an apparatus and method for stitching a material portion having a slip-resistant (sometimes known as "non-slip" or "non-skid") backing which otherwise retards free movement of the material portion during stitching. Most particularly, the present invention relates to an apparatus and method for stitching matting, such as bath mats, entry way mats, etc. having a slip-resistant backing.

BACKGROUND OF THE INVENTION

In general, an apparatus for automatically stitching a material portion is known. For example, the Model 2800-series apparatus commercially available from Jet Sew Technologies Inc. is used to stitch a hem in washcloth material, terry cloth material, and the like. This conventional apparatus uses a clamp member to clamp a portion of washcloth material or the like against a sewing table so that an edge of the washcloth material portion is exposed. The clamp additionally moves the clamped washcloth material portion over the sewing table relative to a sewing head so that the sewing head sews a hem along one or more edges of the washcloth material. The sewing head is rotatable about an axis perpendicular to the sewing table so that the sewing head is maintained in the same orientation relative to the washcloth material portion during sewing, regardless of the movement of the wash cloth material portion (by way of the clamp member).

In particular, the conventional Model 2800-series apparatus uses the clamp member to move the washcloth material portion relative to the sewing head so that consecutive edges of the washcloth material portion are stitched in sequence.

However, the Model 2800-series apparatus depends on the ability to freely slide the washcloth material portion over the sewing table to perform sewing. If the washcloth material portion or the tabletop material or both cause frictional resistance to such relative sliding, then it becomes difficult to consistently slide the material to be sewn, and the quality of the end product deteriorates. In particular, mat material used for bath mats, welcome mats, and the like, including a top surface material ( e.g., carpeting, plastic artificial grass, etc.) and a slip-resistant bottom surface (frequently, but not always, made from rubber) is known, and it would be desirable to provide such a material with an edge binding to prevent fraying between the top surface and the bottom surface. However, the provision of the slip-resistant bottom surface retards, by definition, the free movement of such a mat material portion over the conventional sewing table, and thereby retards efficient processing of such mat material portions.

SUMMARY OF THE PRESENT INVENTION

The present invention therefore provides a sewing mechanism including a sewing head, a sewing table having a sewing surface on which a material portion to be sewn is moved during sewing, and a moving mechanism for moving the material portion over the sewing surface relative to the sewing head during sewing. In general, the sewing mechanism according to the present invention includes a structure, device, or other mechanism by which friction between the material portion and the sewing surface is reduced, thereby facilitating movement of the material portion over the sewing surface with the moving mechanism.

The present invention is also directed to an apparatus for manufacturing a mat, in which a mat portion cut from a web is sewn using a sewing mechanism as generally described above, thereby providing an edge binding about an edge of the mat.

Finally, the present invention is directed to a method of sewing a material portion in which, generally, a structure, device, or other mechanism is provided to reduce friction between the material portion and a sewing surface over which the material portion is moved relative to a sewing head while sewing the material portion.

BRIEF DESCRIPTION OF THE DRAWINGS

The present invention will be described hereinbelow with reference to the figures appended hereto, in which:

FIGS. 8(*a*) to 8(*d*) illustrate the relative motion between a material portion being stitched and the sewing head according to the present invention, including relative rotation of the sewing head;

DETAILED DESCRIPTION OF THE PREFERRED EMBODIMENT(S)

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention wile become apparent to those skilled in the art from this detailed description.

The present invention will be described hereinbelow with reference to the drawings appended hereto.

Figure 1:
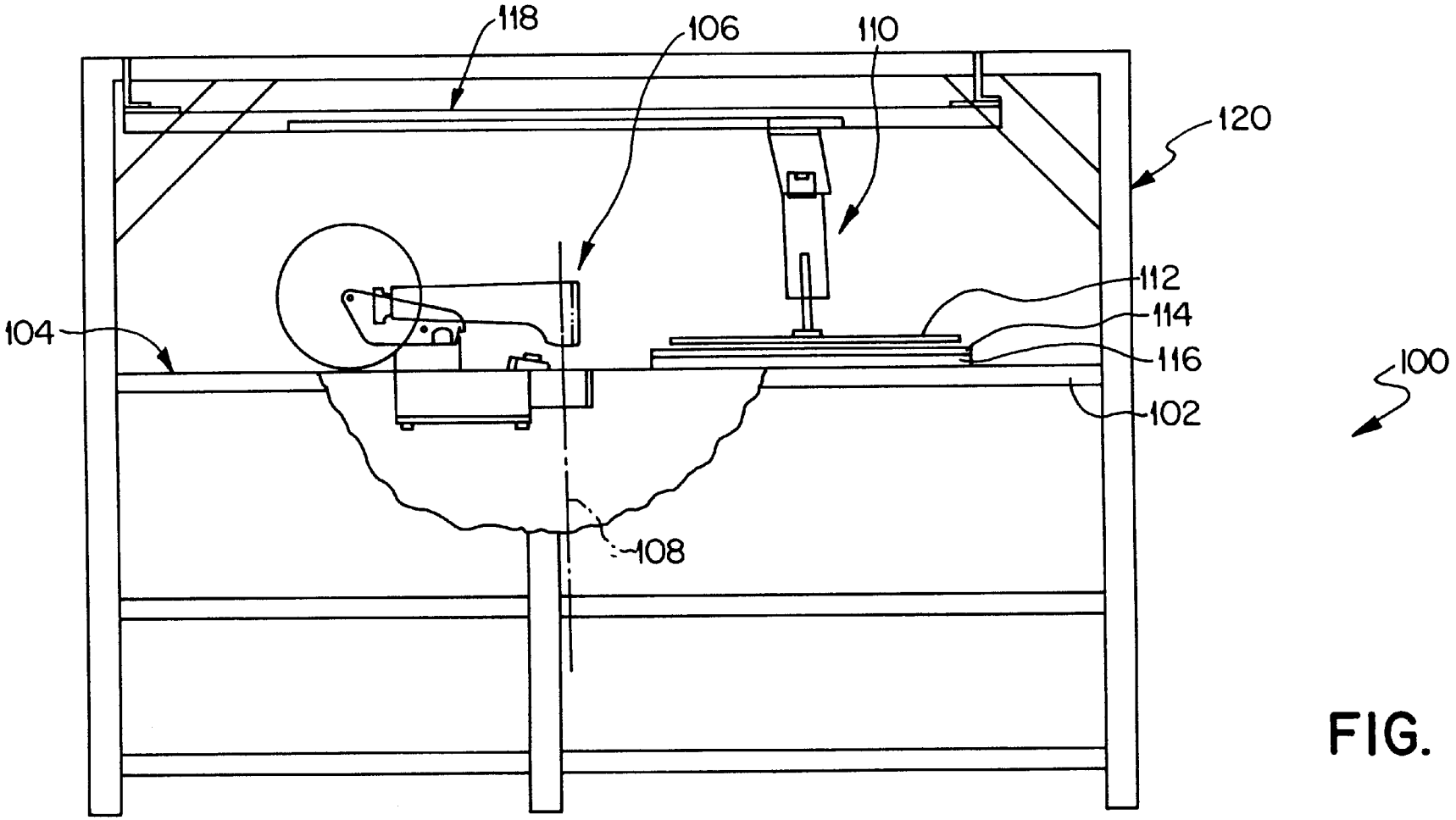
FIG. 1 is a front elevational view of a sewing mechanism according to the present invention.

FIG. 1 illustrates a sewing mechanism 100 according to the present invention. Sewing mechanism 100 includes a sewing table 102 provided with a sewing surface 104. A conventional sewing head 106 is provided on sewing table 102, so as to be rotatable about its needle aligned with axis of rotation 108. For example, sewing table 102 may include a rotatable central region on which sewing head 106 is fixedly mounted. The central region may be selectively rotated by a servomotor or the like in a known manner. In the alternative, sewing head 106 may itself be rotatably movable relative to sewing table 102 and may accordingly be mounted on bearings or the like.

Sewing head 106 may be of any conventionally used type, including, for example, a TITAN Model No. DK2500/3, which is used for overedge stitching. Alternatively, a SINGER Model No. 300W may be used for stitching a binding using chain stitches. Finally, a PEGASUS Model No. TM625 sewing head may also be used in accordance with the present invention.

The sewing mechanism 100 further includes a stitching clamp assembly 110. Clamp assembly 110 includes a clamp head 112 that is selectively movable up and down so as to selectively clamp a material portion 114 (and a friction-reducing material sheet 116, explained later) onto sewing surface 104.

Clamp head 112 may be moved upward and downward in any known manner, such as a hydraulic or pneumatic cylinder, motor-driven gears, or the like.

It is a characteristic of the present invention that the clamp head 112 and the friction-reducing material sheet 116 are sized so as to be slightly smaller than material portion 114, thereby leaving a small edge of the material portion 114 left exposed for stitching with sewing head 106.

Clamp assembly 110 is mounted on a rail system generally indicated by 118. Clamp assembly 110 is driven to move in a known manner by servomotors, belt drives, and the like.

In order to facilitate the movement of material portion 114 over sewing surface 104, a sheet of friction-reducing material 116 is interposed between material portion 114 and sewing surface 104. Friction-reducing material sheet 116 is made from any known sheet material providing good friction-reducing characteristics. An example of a material that is usable in accordance with the present invention is commercially available from under the DuPont Company under the name Delrin® and supplied by companies including Commercial Plastics. Delrin is an acetal resin made by the polymerization of formaldehyde.

An alternative material operable in accordance with the present invention is a commercially available ultra-high molecular weight polyethylene sheet (1/16" thick).

Sewing table 102 (upon which sewing head 106 is provided) and rail system 118 (on which clamp assembly 110 is mounted) are generally mounted in a frame 120.

Figure 2:
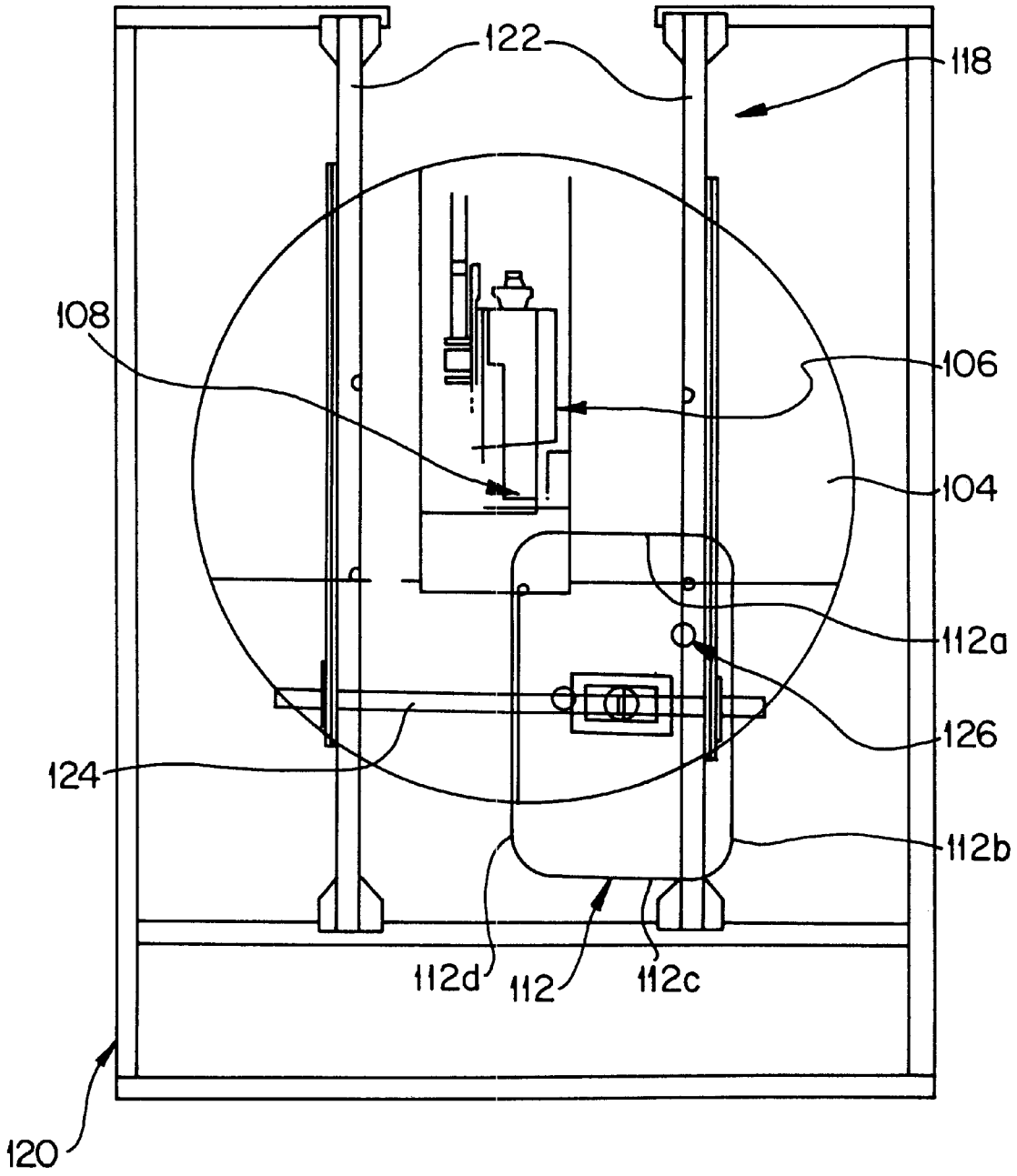
FIG. 2 is a plan view of the sewing mechanism of FIG. 1.

FIG. 2 is a top plan view of the sewing mechanism 100, directed towards sewing surface 104, through rail system 118.

Rail system 118 includes first and second rails 122, 124 which are aligned on mutually orthogonal axes. In one configuration according to the present invention, clamp assembly 110 is slidably mounted on second rail 124 so as to movable therealong (by a servomotor, belt drive, chain drive, or other known mechanism). In turn, second rail 124 is slidably mounted on first rails 122 so as to be movable therealong (again, by a servomotor, belt drive, chain drive, or other known mechanism). By this arrangement, clamp assembly 110 is movable along mutually orthogonal axes. It will be appreciated that if components of motion along the respective axes are combined, then curvilinear motion of clamp assembly 110 is possible.

Accordingly, by the selective movement of clamp assembly 110 along first and/or second rails 122, 124, clamp head 112 (having material portion 114 and friction-reducing material sheet 116 clamped thereunder) is movable relative to sewing head 106 so that, for example, a periphery of the material portion 114 can be stitched. For example, a generally rectangular material portion 114 can have its periphery stitched by, for example, first moving clamp assembly 110 linearly along first rail 122 alone, laterally along second rail 124, in a reverse direction along first rail 122, then finally in a reverse direction along second rail 124.

In accordance with such movement of the material portion 114 (by way of clamp assembly 110), sewing head 106 is preferably rotated in order to be oriented in the same position relative to material portion 114, regardless of each change in direction of material portion 114.

For example, if it is desirable to move a material portion (not shown in FIG. 2, but shown schematically in FIGS. 8(*a*) to 8(*d*)) being sewn laterally relative to sewing head 106, then clamp head 112 would first be moved from right to left relative to the position of sewing head 106 as seen in FIG. 2, such that an edge of material portion 114 parallel to edge 112*a* of clamp head 112 is stitched (see, also, FIG. 8(*a*)).

Thereafter, to stitch an edge of material portion 114 parallel to edge 112*b* of clamp head 112, sewing head 106 is rotated 90° clockwise, relative to axis 108. Clamp head 112 would then move towards the top of page so that the edge of material portion 114 parallel to edge 112*b* is stitched (see, also, FIG. 8(*b*)).

Similarly, to stitch the edge of material portion 114 parallel to edge 112*c*, sewing head 106 is rotated an additional 90° about axis 108 (i.e., 180° from the starting position of sewing head 106), and clamp head 112 is moved from left to right relative to sewing head 106 (see, also, FIG. 8(*c*)).

Finally, sewing head 106 is rotated an additional 90° clockwise (i.e., 270° from its starting position), and clamp head 112 is moved from the top of the page towards the bottom, parallel to edge 112*d* (see, also, FIG. 8(*d*)).

Thereafter, sewing head 106 is rotated an additional 90° (i.e., back to its starting position) to await stitching of a next material portion.

The material portion 114 is positioned by any known method at a starting position before stitching, such as being dragged into place with a movable robot arm 300 provided with a selectively actuable gripper assembly 302. Each gripper assembly 302 is mounted on a rail 304, and can be moved along the length thereof in accordance with the size of a material portion being processed. Each gripper assembly 302 is held in place relative to rail 304 by any known means, such as set screws 306 (see FIG. 9). Each gripper assembly 302 is essentially a pincer mechanism operable by a control signal.

The arm 300 is slidably mounted on a rail (not shown here) oriented transversely to the path of 204 moving through apparatus 200. Arm 300 is driven to move by any suitable means (including, without limitation, hydraulic or pneumatic cylinders, chain drives, or belt drives) in accordance with a suitable control signal.

In addition, arm 300 may be further articulated so as to pivot about an axis 308. In particular, the arm 300 used to drag a material portion 114 into place prior to stitching pivots between an orientation parallel to the direction of travel of web 204 and an orientation perpendicular (i.e., transverse) to the direction of travel of web 204. Specifically, that arm 300 is pivoted so as to be transverse to web 204 after dragging a material portion 114 into place for stitching, as it returns to grab another material portion 114 for stitching. By pivoting in this manner, the arm 300 avoids interfering with the stitching process while being able to return without waiting for stitching to be completed, thereby increasing productivity.

Arm 300 may be pivoted by a selectively actuable cylinder 310 which operates a linkage 312.

The other arm 300 used to pull a stitched material portion 114 off the sewing table 102 after stitching is complete, need not necessarily be pivotable in the above manner. Accordingly, cylinder 310 and linkage 312 may be omitted.

It is a particular feature of the present invention to provide the friction-reducing material sheet 116 interposed between material portion 114 and sewing surface 104, as discussed above. Friction-reducing material sheet 116 is preferably positioned at the starting position by any known method, including, without limitation, manual placement, passive alignment using protruding guides and the like, and active alignment.

In one embodiment of the present invention, the friction-reducing material sheet 116 is preferably provided with one or more positioning holes formed therethrough (such as seen at 126 in FIG. 2). These positioning holes cooperate with a corresponding number of projections which are selectively caused to protrude from the sewing surface 104 so as to pass through respective positioning holes, thereby aligning the friction-reducing material sheet 116.

Figure 7:
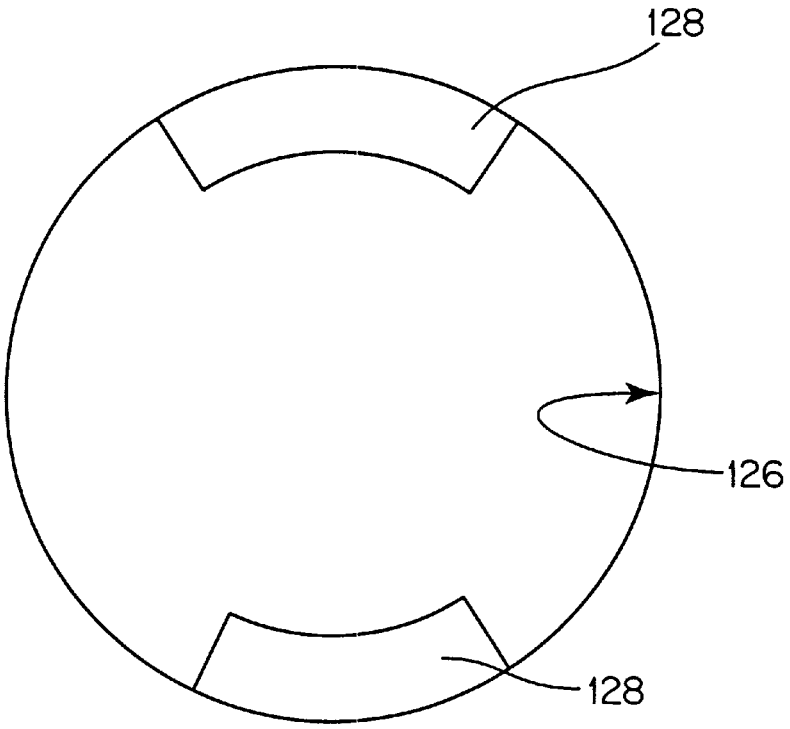
FIG. 7 is a plan view of a positioning mechanism for positioning a friction-reducing material sheet according to the present invention.

In a particular embodiment of the above-described alignment mechanism, each of the projections comprises a plurality of subparts 128 which are selectively radially expansible. Thus, when the projections are initially caused to project from the sewing surface 104, their unexpanded diameter is less than that of a corresponding positioning hole formed in friction-reducing material sheet 116, thereby facilitating passing the projection through the positioning hole. However, in order to thereafter assuredly align the friction-reducing material sheet 116, the subparts 128 of each projection are caused to radially expand so as to assuredly engage with position holes 126 and therefore align the friction-reducing material sheet 116 (see, for example, FIG. 7). Once alignment is completed, the subparts 128 are radially retracted, and the projection is axially retracted so as to no longer protrude from sewing surface 104. Therefore, friction-reducing material sheet 116 is free to move with material portion 114, as moved about by clamp head 112.

The selectively projecting protrusions described above are preferably left protruding (so as to hold the friction-reducing material sheet 116 in place) while a material portion 114 is dragged into place to starting position, so that the friction-reducing material sheet 116 is not moved out of place while the material portion 114 is positioned.

Preferably, the process of stitching material portion 114 is cyclic, such that the clamp assembly 110 returns to the starting position after stitching is complete. After the stitched material portion 114 is returned to the starting position, the projections of the friction-reducing material sheet positioning mechanism are again extended to hold the friction-reducing material sheet 116 in place while the stitched material portion is dragged away (for example, by another movable robot arm 300 provided with the selectively actuable gripper mechanism 302) and while a new material portion 114 is thereafter dragged into place.

Figure 3:
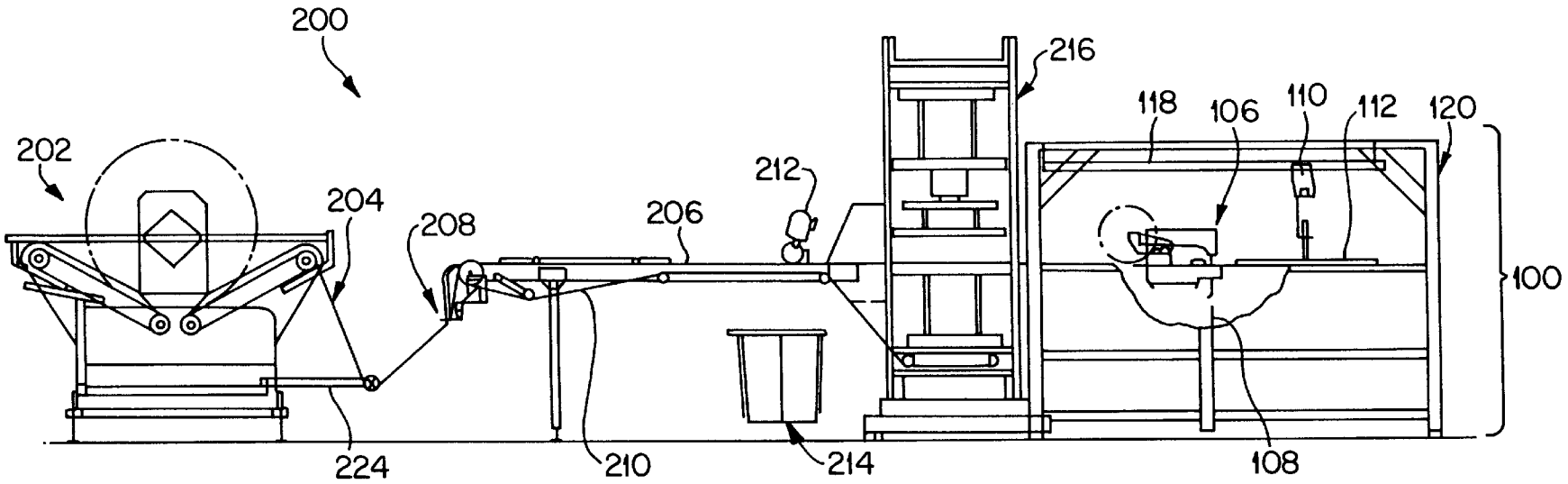
FIG. 3 is a front elevational view of an apparatus for manufacturing a mat according to the present invention.

The sewing mechanism 100 as described above is particularly suited for use in an apparatus for manufacturing mats having an edge binding, as illustrated in FIG. 3.

FIG. 3 illustrates an apparatus 200 according to the present invention. At an upstream location, a mat material supply 202 is provided, wherefrom a supply web of mat material (from which individual mats are cut) is drawn out.

Figure 4:
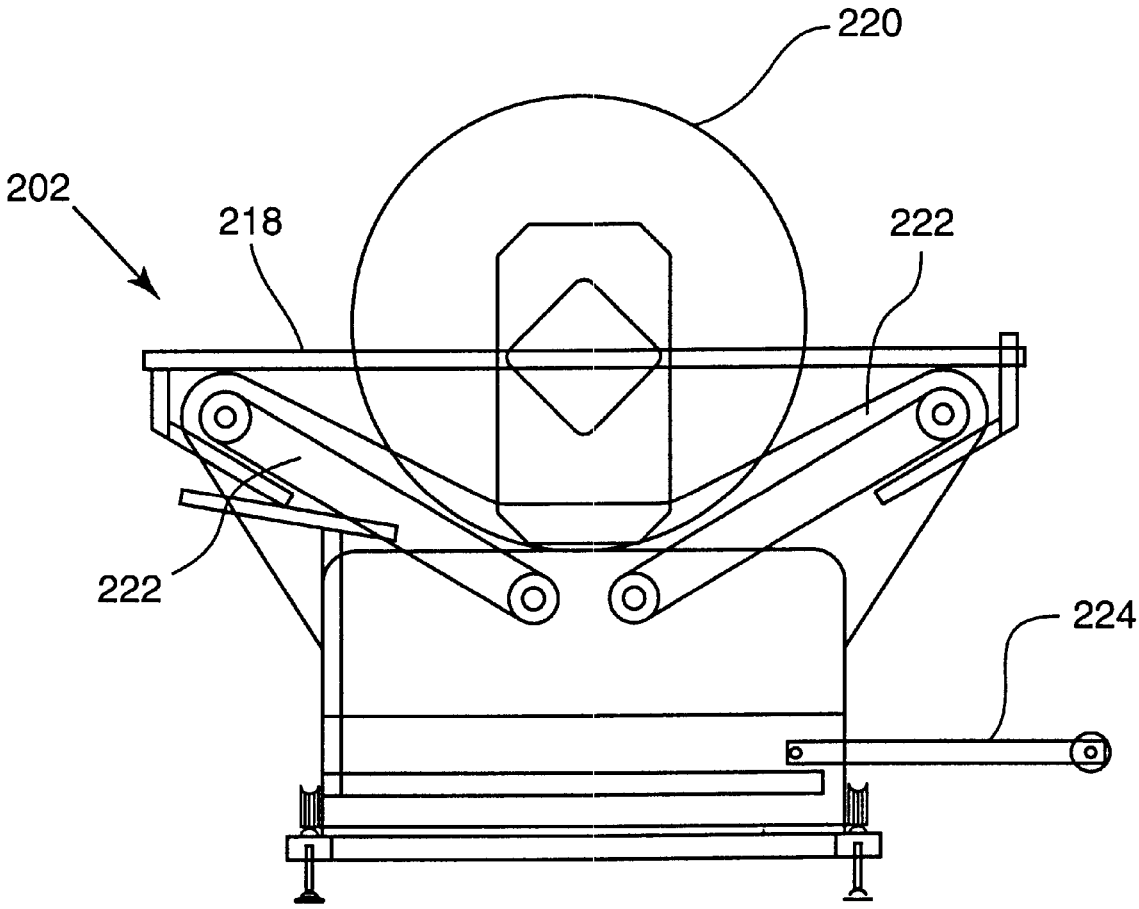
FIG. 4 is a front elevational view of a mat material supply cradle used in the apparatus of FIG. 3.

FIG. 4 illustrates mat material supply 202 in closer detail. Supply 202 generally includes a cradle 218 for supporting a roll of mat material 220. The unrolling of roll 220 may be facilitated by one or more belt drives 222 operating in respective directions to cause the roll 220 to unroll. The cradle 218 may include a dancer bar 224 about which the web 204 is wound, in order to, for example, maintain a desirable tension on the web 204 as it is drawn out.

The web 204 is drawn out onto an infeed table 206. In the process of doing so, it is sometimes desirable to maintain a centered alignment of the web 204 relative to infeed table 206 (using a conventional guide mechanism 208). In addition, cradle 218 may be laterally adjustable (on rollers, bearings, rails, and the like) so as to maintain a centered orientation of the web 204 relative to infeed table 206.

The web 204 is moved along infeed table 206 by any known means, including, for example, a motor-driven serpentine belt 210 driving the web substantially along the entire length of apparatus 200.

Lateral edges of the web 204 are trimmed by any known means, such as edge trimmers 212. Edge trimmers 212 may be, for example, motor-driven blades such as those commercially available from the NC Carpet Company or the Eastman Company. The resultant scrap may be collected in bin 214.

The web 204 having trimmed lateral edges is thereafter moved to a die cutter 216 (such as that commercially available from TTARP). The die cutter 16 is preferably a "kiss-type" die press, wherein the die never contacts the opposing platen. This reduces wear on the die cutter 216 and desirably extends the useful life of the die cutter 216.

As is conventionally known, the die cutter is provided with a die shaped in accordance with a desired mat shape.

Figure 5:
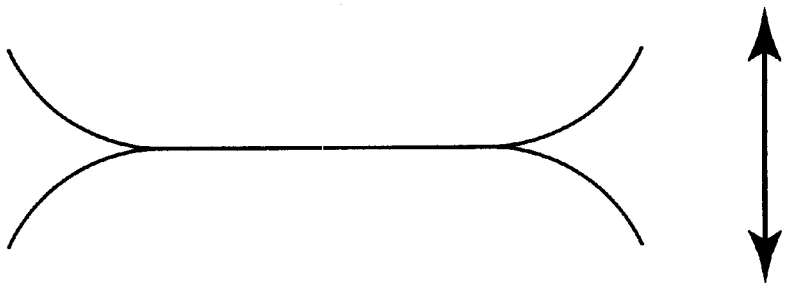
FIG. 5 illustrates an example of the cutting shape of a die used in the die cutter in FIG. 3.

FIG. 5 illustrates, by way of example, a shape of a die usable with the present invention, for obtaining a generally rectangular mat having rounded corners, the die being oriented relative to a direction of movement of web 204 (indicated by the arrow in FIG. 5).

Figure 6:
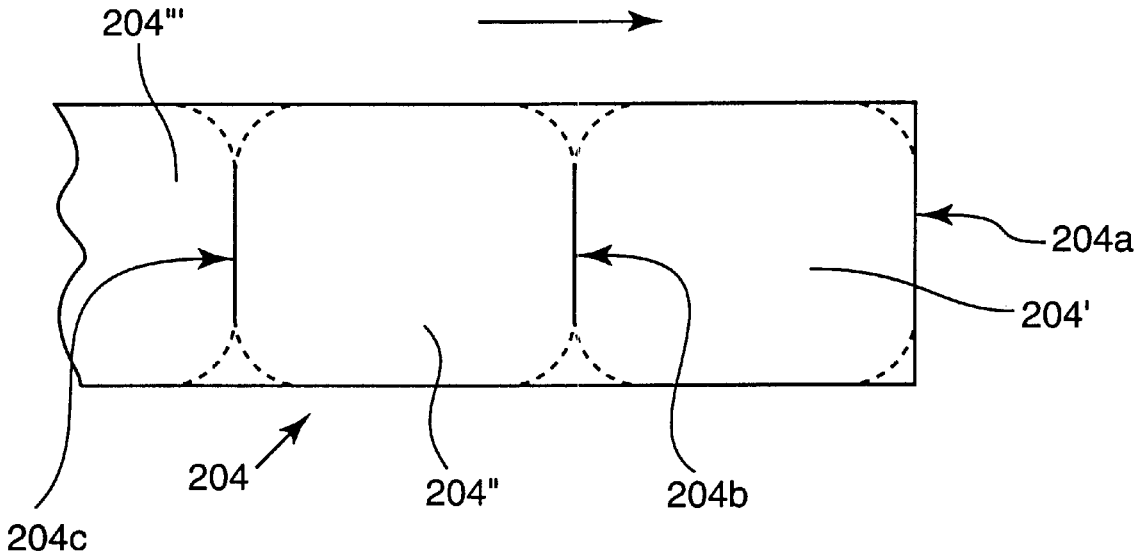
FIG. 6 illustrates a process of cutting successive mat portions from a web using a die shaped as illustrated in FIG. 5.

FIG. 6 schematically illustrates the effect of a die shaped as illustrated in FIG. 5. If a leading edge 204*a* of web 204 is fed into die cutter 216 until leading edge 204*a* is aligned with the die, then a first cut by die cutter 216 results, generally, in the rounding of the corners of leading edge 204*a* of mat 204', as illustrated in phantom in FIG. 6. Thereafter, the web 204 is advanced in the direction of the arrow by the length of one mat, at which point the die cutter 216 is operated again, thereby cutting a trailing edge of a first mat 204' and forming a leading edge of a second mat 204" at edge 204*b* due to the characteristic shape of the die, as illustrated in FIG. 5. The web 204 is advanced again by the length of one mat, where the die cutter 216 is operated again. Therefore, the trailing edge of second mat 204" and the leading edge of third mat 204"' are cut at edge 204*c*. This process is repeated along the length of web 204. As is evident, this form of cutting reduces the amount of scrap formed in cutting the respective mats 204', 204", 204"', etc. In addition, by using two die cutter cycles to form a given mat, the amount of press force required to operate the die cutter 216 is reduced, beneficially reducing wear on the die cutter 216.

After respective mats are cut from web 204, each mat is pulled into the aforementioned starting position of the sewing mechanism 100. A description of sewing mechanism 100 is as set forth above, and repetition here is avoided.

Sewing mechanism 100 is therefore operated to, for example, sew an edge of each mat so as to prevent fraying (e.g., between a backing and a carpet pile). As discussed above, an overedge stitch binding may be provided, or a binding material may be chain-stitched onto an edge of the mats.

Synchronized (or, otherwise, coordinated) operation of the various elements of the above-disclosed sewing mechanism and/or mat manufacturing apparatus (including at least operation of the sewing clamp assembly 110, sewing head 106, die cutter 216, friction-reducing material sheet positioning mechanism, and movable arm(s) 300) is provided by Pentium® PC-based control, especially using computer control provided by a plug-in computer board manufactured by and commercially available from the Motion Engineering Company.

Figure 9:
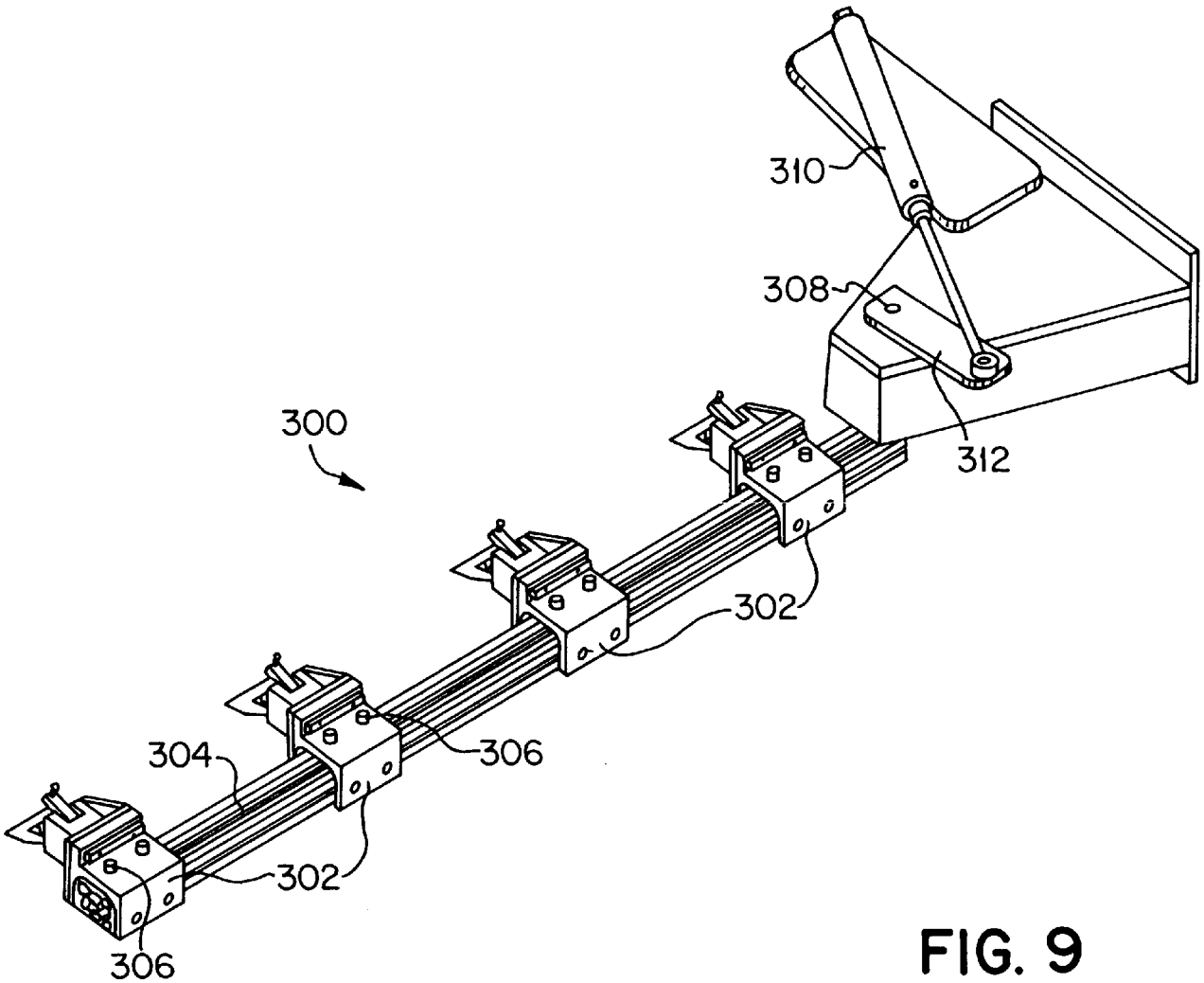
FIG. 9 is a perspective view of a movable arm provided with gripper assemblies and used to move a material portion into position for stitching and to move a stitched material portion away after stitching.
Figure 10:
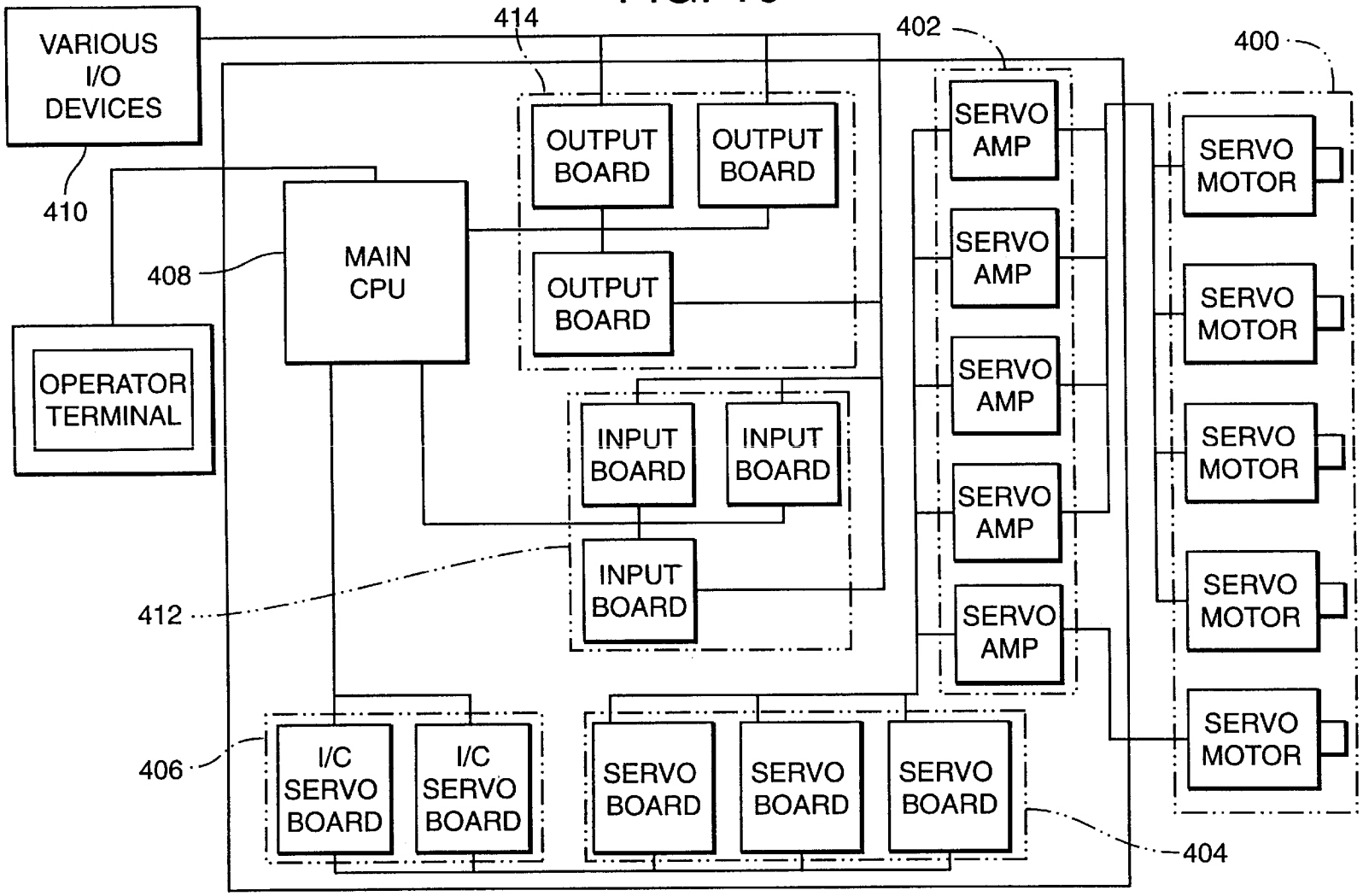
FIG. 10 is a block diagram illustrating how the apparatus of FIG. 3 is controlled.

FIG. 9 schematically illustrates an example of how the apparatus of FIG. 3 is controlled according to the present invention.

A plurality of servo motors 400 operate or otherwise drive various portions of the apparatus, including, for example, the clamping assembly 110, rotation of the sewing head 106, etc. Each of the servo motors 400 is connected to a respective servo amplifier 402. The servo amplifiers 402 are in turn connected one or more servo boards 404. The servo boards 404 provide control signals to the servo motors 400 for controlling the servo motors 400, and the servo amplifiers 402 provide feedback to the servo boards 404 regarding the operational status of the servo motors 400.

The servo boards 404 are connected to input/output servo boards 406, which process control signals from main CPU 408 relative to the information input from servo amplifiers 402.

Other input/output devices (generally indicated at 410) in the apparatus sense information about, for example, web 204 position and movement, operational status of edge trimmers 212, operational status of friction-reducing material sheet positioning mechanism, etc. This information is operated on by input boards 412 and output boards 414 under the overall control of CPU 408 in order to operate and control those parameters.

It is noted that I/O servo boards 406 generally operate on information faster than input boards 412 and output boards 414, such that the I/O server boards 406 are used to control relatively faster moving processes, such as the coordination of operation between sewing head 106 and clamp assembly 110.

In addition, the block outline indicated at 416 corresponds to a control cabinet containing the devices shown inside of block 416.

Operator terminal 418 is typically a display/keyboard input/output terminal by which operational settings can be input and operating information can be output.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sewing mechanism for sewing a material portion, comprising:

a sewing head;

a sewing table providing a sewing surface along which the material portion is moved during sewing;

a material portion moving mechanism constructed and arranged to move the material portion along said sewing surface relative to the sewing head; and a friction-reducing member provided between the material portion and said sewing surface so as to facilitate moving the material portion with said material portion moving mechanism, the friction-reducing member being arranged to move with the material portion.

2. The mechanism according to claim 1, wherein said material portion moving mechanism is constructed and arranged to move the material portion along at least one of a pair of mutually orthogonal axes lying in a plane of said sewing surface.

3. The mechanism according to claim 2, wherein said material portion moving mechanism is constructed arranged to move the material portion along both of said axes simultaneously.

4. The mechanism according to claim 3, wherein said material portion moving mechanism comprises:

a first rail oriented along a first axis;

a movable clamp constructed and arranged to selectively clamp the material portion between the clamp and said sewing surface, said clamp being movably mounted on said first rail so as to selectively move along said first axis;

a second rail oriented along a second axis orthogonal to said first axis, said first rail having said clamp movably mounted thereon being movably mounted on said second rail such that said clamp is further movable along said second axis; and a driving mechanism constructed and arranged to move said clamp along said first rail and said first rail having said clamp mounted thereon along said second rail.

5. The mechanism according to claim 1, wherein said friction-reducing member comprises a friction-reducing sheet interposed between the material portion and said sewing surface.

6. The mechanism according to claim 5, wherein said friction-reducing sheet is one of an ultra-high molecular weight polyethylene sheet and an acetal resin sheet.

7. The mechanism according to claim 1, wherein said sewing head is rotatable about an axis perpendicular to said sewing surface.

8. The mechanism according to claim 7, wherein said sewing head is constructed and arranged to be rotated so as to maintain the same orientation relative to the material portion while the material portion is moved by said material portion moving mechanism during sewing.

9. The mechanism according to claim 1, wherein said sewing head is constructed and arranged to sew an edge of the material portion.

10. The mechanism according to claim 9, wherein said sewing head is constructed and arranged to provide an overedge stitch on the edge of the material portion.

11. The mechanism according to claim 9, wherein said sewing head is constructed and arranged to stitch a binding onto the edge of the material portion.

12. The mechanism according to claim 1, further comprising a material portion positioning mechanism constructed and arrange to move the material portion into a start position on said sewing surface before the material portion is sewed.

13. The mechanism according to claim 12, wherein said material portion positioning mechanism is constructed and arranged to also move the sewed material portion off of said sewing surface after the material portion is sewed.

14. The mechanism according to claim 13, wherein said material portion positioning mechanism comprises a pair of selectively movable arms, each including a gripper mechanism for gripping the material portion, wherein one said movable arm is constructed and arranged to move the material portion into the start position by gripping the material portion with its gripper mechanism and moving the material portion into the start position, and the other movable arm is constructed and arranged to move the material portion off said sewing surface by gripping the sewed material portion with its gripper mechanism and pulling the sewed material portion off the sewing table.

15. The mechanism according to claim 12, wherein said friction-reducing member comprises a friction-reducing sheet interposed between the material portion and said sewing surface.

16. The mechanism according to claim 15, further comprising a friction-reducing sheet positioning mechanism constructed and arranged to position said friction-reducing sheet at the start position.

17. The mechanism according to claim 16, wherein said friction-reducing sheet includes a positioning hole formed therein, and said friction-reducing sheet positioning mechanism comprises a projection constructed and arranged to selectively protrude from said sewing surface so as to pass through said positioning hole, thereby orienting said friction-reducing sheet relative to said sewing surface.

18. The mechanism according to claim 17, wherein said friction-reducing sheet includes at least two positioning holes formed therein, and said friction-reducing sheet positioning mechanism comprises at least two projections constructed and arranged to selectively protrude from said sewing surface so as to pass through said respective positioning holes, thereby orienting said friction-reducing sheet relative to said sewing surface.

19. The mechanism according to claim 18, wherein each said projection has an effective diameter less than a corresponding said positioning hole, each said projection comprising at least a pair of subparts which are laterally spreadable so as to engage said positioning hole.

20. An apparatus for manufacturing a mat having an edge binding, comprising:

a mat material supply constructed and arranged to supply a web of the mat material;

a drawing mechanism constructed and arranged to draw the web along;

a die cutter including a die shaped to cut a mat from the web;

a sewing mechanism for providing a binding on an edge of each mat, comprising:

a sewing head;

a sewing table providing a sewing surface along which the mat is moved during sewing;

a mat moving mechanism constructed and arranged to move the mat along said sewing surface relative to the sewing head; and a friction-reducing member provided between the mat and said sewing surface so as to facilitate moving the mat with said mat moving mechanism.

21. The apparatus according to claim 20, where in s aid mat material supply comprises a cradle constructed and arranged to hold a roll of the mat material web.

22. The apparatus according to claim 21, wherein said cradle includes a powered belt drive constructed and arranged to move the roll of the mat material web in an unrolling direction.

23. The apparatus according to claim 22, wherein said cradle includes a dancer bar about which the mat material web is threaded after being unrolled from the roll of the mat material web.

24. The apparatus according to claim 20, further comprising an infeed table upstream of said die cutter along which the mat material web is moved.

25. The apparatus according to claim 24, further comprising edge trimmers located on opposite lateral sides of said infeed table for trimming respective lateral edges of the mat material web.

26. The apparatus according to claim 25, wherein said edge trimmers are motor-driven blades.

27. The apparatus according to claim 25, wherein on said edge trimmer is fixed and the other said edge trimmer is positionally-adjustable.

28. The apparatus according to claim 20, wherein said die is shaped to cut a trailing edge of a first mat and a leading edge of a second mat simultaneously.

29. The apparatus according to claim 20, wherein said die cutter is a kiss die cutter.

30. The apparatus according to claim 20, wherein said mat moving mechanism is constructed and arranged to move the mat along at least one of a pair of mutually orthogonal axes lying in a plane of said sewing surface.

31. The apparatus according to claim 20, wherein said mat moving mechanism is constructed arranged to move the mat along both of said axes simultaneously.

32. The apparatus according to claim 31, wherein said mat moving mechanism comprises:

a first rail oriented along a first axis;

a movable clamp constructed and arranged to selectively clamp the mat between the clamp and said sewing surface, said clamp being movably mounted on said first rail so as to selectively move along said first axis;

a second rail oriented along a second axis orthogonal to said first axis, said first rail having said clamp movably mounted thereon being movably mounted on said second rail such that said clamp is further movable along said second axis; and a driving mechanism constructed and arranged to move said clamp along said first rail and said first rail having said clamp mounted thereon along said second rail.

33. The apparatus according to claim 20, wherein said friction-reducing member comprises a friction-reducing sheet interposed between the mat and said sewing surface.

34. The apparatus according to claim 33, wherein said friction-reducing sheet is one of an ultra-high molecular weight polyethylene sheet and an acetal resin sheet.

35. The apparatus according to claim 20, wherein said sewing head is rotatable about an axis perpendicular to said sewing surface.

36. The apparatus according to claim 35, wherein said sewing head is constructed and arranged to be rotated so as to maintain the same orientation relative to the mat while the mat is moved by said mat moving mechanism during sewing.

37. The apparatus according to claim 20, wherein said sewing head is constructed and arranged to sew an edge of the mat.

38. The apparatus according to claim 37, wherein said sewing head is constructed and arranged to provide an overedge stitch on the edge of the mat.

39. The apparatus according to claim 37, wherein said sewing head is constructed and arranged to stitch a binding onto the edge of the mat.

40. The apparatus according to claim 20, further comprising a mat positioning mechanism constructed and arrange to move the mat into a start position on said sewing surface before the mat is sewed.

41. The apparatus according to claim 40, wherein said material portion positioning mechanism is constructed and arranged to also move the sewed mat off of said sewing surface after the mat is sewed.

42. The apparatus according to claim 41, wherein said mat positioning mechanism comprises a pair of selectively movable arms, each including a gripper mechanism for gripping the mat, wherein one said movable arm is constructed and arranged to move the mat into the start position by gripping the mat with its gripper mechanism and moving the mat into the start position, and the other movable arm is constructed and arranged to move the mat off said sewing surface by gripping the sewed mat with its gripper mechanism and pulling the sewed mat off the sewing table.

43. The apparatus according to claim 40, wherein said friction-reducing member comprises a friction-reducing sheet interposed between the mat and said sewing surface.

44. The apparatus according to claim 40, further comprising a friction-reducing sheet positioning mechanism constructed and arranged to position said friction-reducing sheet at the start position.

45. The apparatus according to claim 44, wherein said friction-reducing sheet includes a positioning hole formed therein, and said friction-reducing sheet positioning mechanism comprises a projection constructed and arranged to selectively protrude from said sewing surface so as to pass through said positioning hole, thereby orienting said friction-reducing sheet relative to said sewing surface.

46. The apparatus according to claim 45, wherein said friction-reducing sheet includes at least two positioning holes formed therein, and said friction-reducing sheet positioning mechanism comprises at least two projections constructed and arranged to selectively protrude from said sewing surface so as to pass through said respective positioning holes, thereby orienting said friction-reducing sheet relative to said sewing surface.

47. The apparatus according to claim 46, wherein each said projection has an effective diameter less than a corresponding said positioning hole, each said projection comprising at least a pair of subparts which are laterally spreadable so as to engage said positioning hole.

48. The apparatus according to claim 20, wherein the mat material has a slip-resistant backing.

49. The apparatus according to claim 48, wherein said friction-reducing member for reducing friction between the mat and said sewing surface comprises a friction-reducing member for reducing friction between said slip-resistant backing and said sewing surface.

50. A method for sewing a material portion, comprising the steps of:

providing a friction-reducing material sheet between the material portion and a sewing surface to facilitate movement of the material portion over the sewing surface during sewing; and moving the material portion and the friction-reducing material sheet over the sewing surface relative to a sewing device while sewing the material portion with the sewing device.

51. The method according to claim 50, wherein the material portion includes a slip-resistant backing facing the friction-reducing material sheet.

52. The method according to claim 51, wherein the friction-reducing material sheet is an ultra-high molecular weight polyethylene.

53. The method according to claim 52, wherein the friction-reducing material sheet is an acetal resin.

* * * * *